US009592663B2

(12) United States Patent
Ishii et al.

(10) Patent No.: US 9,592,663 B2
(45) Date of Patent: Mar. 14, 2017

(54) LIQUID EJECTING HEAD UNIT AND LIQUID EJECTING APPARATUS

(71) Applicant: SEIKO EPSON CORPORATION, Tokyo (JP)

(72) Inventors: Hiroyuki Ishii, Shiojiri (JP); Hiroshige Owaki, Okaya (JP); Katsuhiro Okubo, Azumino (JP); Hiroyuki Hagiwara, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 70 days.

(21) Appl. No.: 13/850,996

(22) Filed: Mar. 26, 2013

(65) Prior Publication Data

US 2013/0293627 A1 Nov. 7, 2013

(30) Foreign Application Priority Data

May 2, 2012 (JP) ..... 2012-105455
Jun. 7, 2012 (JP) ..... 2012-129944
Oct. 15, 2012 (JP) ..... 2012-227710

(51) Int. Cl.
*B41J 2/01* (2006.01)
*B41J 2/155* (2006.01)
*B41J 2/175* (2006.01)

(52) U.S. Cl.
CPC ..... *B41J 2/01* (2013.01); *B41J 2/155* (2013.01); *B41J 2/1752* (2013.01); *B41J 2202/19* (2013.01)

(58) Field of Classification Search
CPC ..... B41J 11/008; B41J 11/2135; B41J 25/001
USPC ..... 347/40, 85, 84
See application file for complete search history.

(56) References Cited

U.S. PATENT DOCUMENTS 4,499,480 A * 2/1985 Takatori et al. ..... 347/42
4,559,543 A * 12/1985 Toganoh et al. ..... 347/32
5,160,945 A * 11/1992 Drake ..... 347/42
5,257,043 A * 10/1993 Kneezel ..... 347/42
5,782,184 A * 7/1998 Albertalli ..... B41J 2/155 101/486
5,933,163 A * 8/1999 Koizumi et al. ..... 347/42
6,315,390 B1 11/2001 Fujii et al.
6,585,350 B2 * 7/2003 Barinaga ..... 347/33
6,652,081 B2 * 11/2003 Shimizu ..... 347/85
6,926,385 B2 * 8/2005 Rai et al. ..... 347/40
6,955,788 B2 * 10/2005 Richards ..... 435/286.2
(Continued)

FOREIGN PATENT DOCUMENTS

JP 5-270099 10/1993
JP 7-290711 11/1995
(Continued)

*Primary Examiner* — Matthew Luu
*Assistant Examiner* — Patrick King
(74) *Attorney, Agent, or Firm* — Workman Nydegger

(57) ABSTRACT

A liquid ejecting head unit includes a liquid ejecting head that ejects liquid through a nozzle formed in a nozzle surface, and a holding member to which the liquid ejecting head is attached. Further, in the liquid ejecting head unit, the holding member includes a holder that supports the liquid ejecting head in a predetermine direction which is different from a direction of the nozzle surface of the liquid ejecting head, and a base portion that sticks out from the holder to a side which is parallel to the predetermined direction.

14 Claims, 14 Drawing Sheets

(56) References Cited

U.S. PATENT DOCUMENTS

| | | | | |
|---|---|---|---|---|
| 6,975,466 | B2 * | 12/2005 | Umeyama et al. | 359/896 |
| 7,036,910 | B2 | 5/2006 | Ohashi et al. | |
| 7,073,884 | B2 * | 7/2006 | Ueda | 347/20 |
| 7,114,793 | B2 * | 10/2006 | Katsuta et al. | 347/22 |
| 7,264,346 | B2 * | 9/2007 | Nishino et al. | 347/102 |
| 7,431,428 | B2 * | 10/2008 | Yamada | B41J 2/15 347/40 |
| 7,699,417 | B2 * | 4/2010 | Inoue | 347/8 |
| 7,992,967 | B2 | 8/2011 | Yamanaka | |
| 2002/0001019 | A1 | 1/2002 | Kudo et al. | |
| 2002/0033857 | A1 | 3/2002 | Ohashi et al. | |
| 2005/0162463 | A1 * | 7/2005 | Silverbrook et al. | 347/40 |
| 2006/0214986 | A1 * | 9/2006 | Yagi et al. | 347/40 |
| 2009/0174750 | A1 | 7/2009 | Saito | |
| 2009/0189943 | A1 | 7/2009 | Taira et al. | |
| 2009/0231390 | A1 * | 9/2009 | Ouchi | 347/40 |
| 2009/0295882 | A1 * | 12/2009 | Hagiwara | 347/85 |
| 2010/0214350 | A1 | 8/2010 | Oguchi | |
| 2011/0050815 | A1 * | 3/2011 | Kakigahara | 347/85 |
| 2011/0063368 | A1 | 3/2011 | Kim et al. | |
| 2011/0221822 | A1 | 9/2011 | Hagiwara et al. | |
| 2012/0113189 | A1 * | 5/2012 | Kobayashi et al. | 347/40 |

FOREIGN PATENT DOCUMENTS

| | | | |
|---|---|---|---|
| JP | 09-201957 | | 8/1997 |
| JP | 10-024573 | | 1/1998 |
| JP | 2000-351211 | | 12/2000 |
| JP | 2001-232817 | | 8/2001 |
| JP | 2002-264322 | | 9/2002 |
| JP | 2003-053980 | | 2/2003 |
| JP | 2004-025807 | | 1/2004 |
| JP | 2008-012854 | | 1/2008 |
| JP | 2008-221745 | | 9/2008 |
| JP | 2009-072966 | | 9/2009 |
| JP | 2009-285840 | | 12/2009 |
| JP | 2009-285899 | | 12/2009 |
| JP | 2009285840 | A * | 12/2009 |
| JP | 2010-030230 | | 2/2010 |
| JP | 2010-167607 | | 8/2010 |
| JP | 2011-031606 | | 2/2011 |

* cited by examiner

LIQUID EJECTING HEAD UNIT AND LIQUID EJECTING APPARATUS

CROSS REFERENCES TO RELATED APPLICATIONS

The entire disclosure of Japanese Patent Application Nos. 2012-105455, filed May 2, 2012, 2012-129944, filed Jun. 7, 2012, and 2012-227710, filed Oct. 15, 2012, are incorporated by reference herein.

BACKGROUND

1. Technical Field

The present invention relates to liquid ejecting head units and liquid ejecting apparatuses, particularly to ink jet recording head units that discharge ink as liquid and ink jet recording apparatuses.

2. Related Art

A liquid ejecting apparatus is an apparatus that includes a liquid ejecting head capable of ejecting liquid as a droplet through nozzles and ejects various kinds of liquid from this liquid ejecting head. As an representative example of the liquid ejecting apparatus, for example, an image recording apparatus such as an ink jet recording apparatus (printer) or the like that includes an ink jet recording head (hereinafter, also called a "recording head") and performs printing by ejecting a liquid ink as an ink droplet through a nozzle in the recording head, can be cited. In addition, the liquid ejecting apparatus is employed for ejecting various kinds of liquids such as coloring materials used in color filters of liquid crystal displays and the like, organic materials used in electro luminescence (EL) displays, electrode materials used in the formation of electrodes, and so on. A recording head of the image recording apparatus ejects a liquid ink, while a coloring material ejecting head of a display manufacturing apparatus ejects solutions of coloring materials of red (R), green (G) and blue (B). Further, an electrode ejecting head of an electrode material formation apparatus ejects a liquid electrode material, and a bioorganic matter ejecting head of a chip manufacturing apparatus ejects a solution of bioorganic matter.

Of the above-mentioned printers, such a printer is provided that is equipped with a recording head unit in which a plurality of recording heads are fixed to a support member (for example, see JP-A-2008-221745). Each of the recording heads is so configured as to introduce ink into a pressure chamber (pressure generation chamber) from an ink supply source such as an ink cartridge or the like, generate a change in pressure in the ink within the pressure chamber by activating a pressure generation unit such as a piezoelectric element, a heating element or the like, and eject the ink within the pressure chamber as an ink droplet through a nozzle that is opened in a nozzle surface by making use of the change in pressure. The support member is a plate-like member which is parallel to the nozzle surface of the recording head, and in which an opening portion is provided penetrating through in a plate-thickness direction thereof. Each of the recording heads is fixed to the border of the opening portion with a screw or the like while the nozzle surface thereof is exposed from the opening portion of the support member.

Recently, recording head units have been required to be smaller in size. However, in the above configuration, because the recording heads are fixed to the border of the opening portion of the support member, it has been difficult to miniaturize the recording head unit. In other words, in order to prevent deformation of the support member, an appropriate strength of the support member need be ensured; accordingly, the border of the opening portion is apt to be widened. In particular, the width of the support member in a direction perpendicular to an alignment direction of the recording heads cannot be shortened; as a result, it has been difficult to shorten the width of the recording head unit.

SUMMARY

An advantage of some aspects of the invention is to provide a liquid ejecting head unit that can be miniaturized and a liquid ejecting apparatus including this head unit.

A liquid ejecting head unit according to an aspect of the invention includes: a liquid ejecting head that has a nozzle surface in which a nozzle is formed, a pressure chamber communicating with the nozzle, and a pressure generation unit that generates a change in pressure within the pressure chamber, and that ejects liquid through the nozzle by driving the pressure generation unit to generate a change in pressure in the pressure chamber; and a support member to which the plurality of liquid ejecting heads are attached. Further, in the liquid ejecting head unit, the support member includes: a support wall having an attachment surface perpendicular to the nozzle surface of the liquid ejecting head that is to be attached to the stated attachment surface; and a flange sticking out from the attachment surface of the support wall in a direction intersecting with the attachment surface.

According to the aspect of the invention, since the flange that sticks out from the attachment surface of the support wall in the direction intersecting with the attachment surface, the strength of the support wall can be appropriately ensured, whereby the plate-thickness in a direction perpendicular to the attachment surface of the support wall can be thinner. This makes it possible to thin the width of the liquid ejecting head unit in the direction perpendicular to the attachment surface, whereby the liquid ejecting head unit can be miniaturized.

It is preferable for the flange to be provided at a position on the support wall at the side of a surface opposite to the nozzle surface of the liquid ejecting head.

According to this configuration, the flange can be provided in a state in which it does not interfere with the nozzle surface and overlaps with the nozzle surface when viewed from the nozzle surface side. Accordingly, a series of flanges across the plurality of liquid ejecting heads can be provided, whereby the strength of the support wall can be enhanced. This makes it possible to suppress deformation of the support wall and to make the plate-thickness in the direction perpendicular to the attachment surface of the support wall be thinner.

In the above configuration, it is preferable for the support member to be made of a metal.

According to this structure, it is possible to enhance rigidity of the support wall, whereby the plate-thickness in the direction perpendicular to the attachment surface of the support wall can be further thinned.

Further, it may be preferable that the liquid ejecting head unit include: a holding member having a base portion that is provided with a first liquid channel penetrating through in the thickness direction thereof in which liquid flows, and having a holder that is erected on the base portion; and the plurality of liquid ejecting heads each of which has a second liquid channel that is open at one side in which liquid flows, and discharges liquid supplied from the second liquid channel. Furthermore, it may be preferable that, in the liquid ejecting head unit, each of the plurality of liquid ejecting heads be fixed to the holder with the open side of the second liquid channel being opposed to the base portion, and the second liquid channel be connected with the first liquid channel.

According to this aspect, because it is unnecessary to ensure an area in which a connecting portion between the first and second liquid channels is located between the liquid ejecting heads, an interval between the liquid ejecting heads can be shortened as much as possible. Through this, a miniaturized liquid ejecting head unit can be provided. Note that the first liquid channel penetrates through in the thickness direction. That is, the first liquid channel is not excessively bent in the vicinity of the connecting portion with the second liquid channel, which can prevent pressure loss of the liquid.

Here, it is preferable that a tube member through which liquid flows be inserted into the first liquid channel, an insertion portion in which the second liquid channel is open and which sticks out toward the first liquid channel side be provided in an area of the liquid ejecting head on the side facing to the first liquid channel, and the second liquid channel communicate with the tube member by inserting the insertion portion into the inside of the tube member that is inserted into the first liquid channel. With this, the insertion portion side of the tube member is prevented from being excessively bent, whereby pressure loss of the liquid can be prevented.

Further, it is preferable that the leading portion of the tube member be bent outward centered at the insertion portion and be sandwiched between the liquid ejecting head and the base portion. With this, it is possible to prevent a leakage of liquid from the tube member.

Moreover, it may be preferable that the liquid ejecting head unit include the liquid ejecting head that ejects liquid through the nozzle formed in the nozzle surface and the holding member to which the liquid ejecting head is attached, and that the holding member include the holder that supports the liquid ejecting head in a predetermined direction which is different from a direction of the nozzle surface of the liquid ejecting head, and the base portion that sticks out from the holder to a side parallel to the predetermine direction.

The base portion may be provided sticking out from a position on the holder at an opposite side to the nozzle surface side of the liquid ejecting head.

The holding member may be made of a metal.

It is preferable for the base portion to include the first liquid channel which penetrates through in the thickness direction thereof and in which liquid is made to flow, for the liquid ejecting head to include the second liquid channel that supplies liquid to the nozzle, for the liquid ejecting head to be fixed to the holder with an opening of the second liquid channel facing to the base portion, and for the second liquid channel to be connected with the first liquid channel.

Further, it is preferable that the tube member for flowing liquid be inserted into the first liquid channel, and that the tube member be connected with the liquid ejecting head so as to flow the liquid.

It is preferable that the liquid ejecting head include the insertion portion in which the second liquid channel is open and which sticks out toward the first liquid channel side, and that the second liquid channel communicate with the tube member either by inserting the insertion portion into the inside of the tube member which is inserted into the first liquid channel or by inserting the tube member into the inside of the insertion portion.

It is preferable for the leading portion of the tube member to be bent outward centered at the insertion portion and be sandwiched between the liquid ejecting head and the base portion.

A liquid ejecting apparatus according to another aspect of the invention includes the liquid ejecting head unit according to the above-described aspects.

According to this aspect, it is possible to realize a liquid ejecting apparatus which can be miniaturized, and in which the pressure loss can be reduced by reducing flow resistance in a channel that supplies liquid to each of the liquid ejecting heads.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Hereinafter, the invention will be described in detail based on embodiments of the invention. An ink jet recording head unit is an example of a liquid ejecting head unit and is simply called a "head unit" as well. An ink jet recording head is an example of a liquid ejecting head and is simply called a "head" as well.

Figure 1:
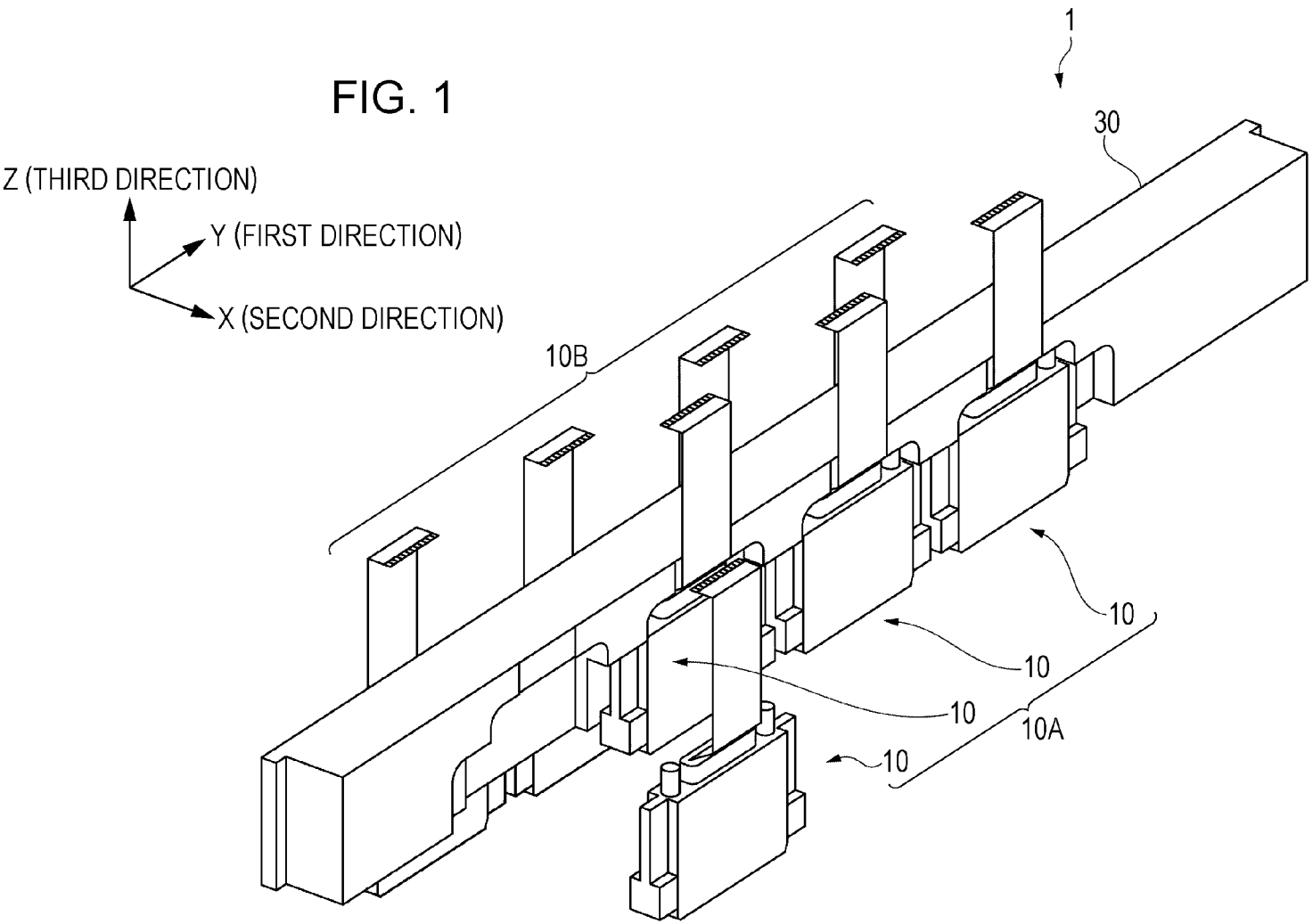
FIG. 1 is a schematic perspective view illustrating the top face side of a head unit according to an embodiment of the invention.
Figure 2:
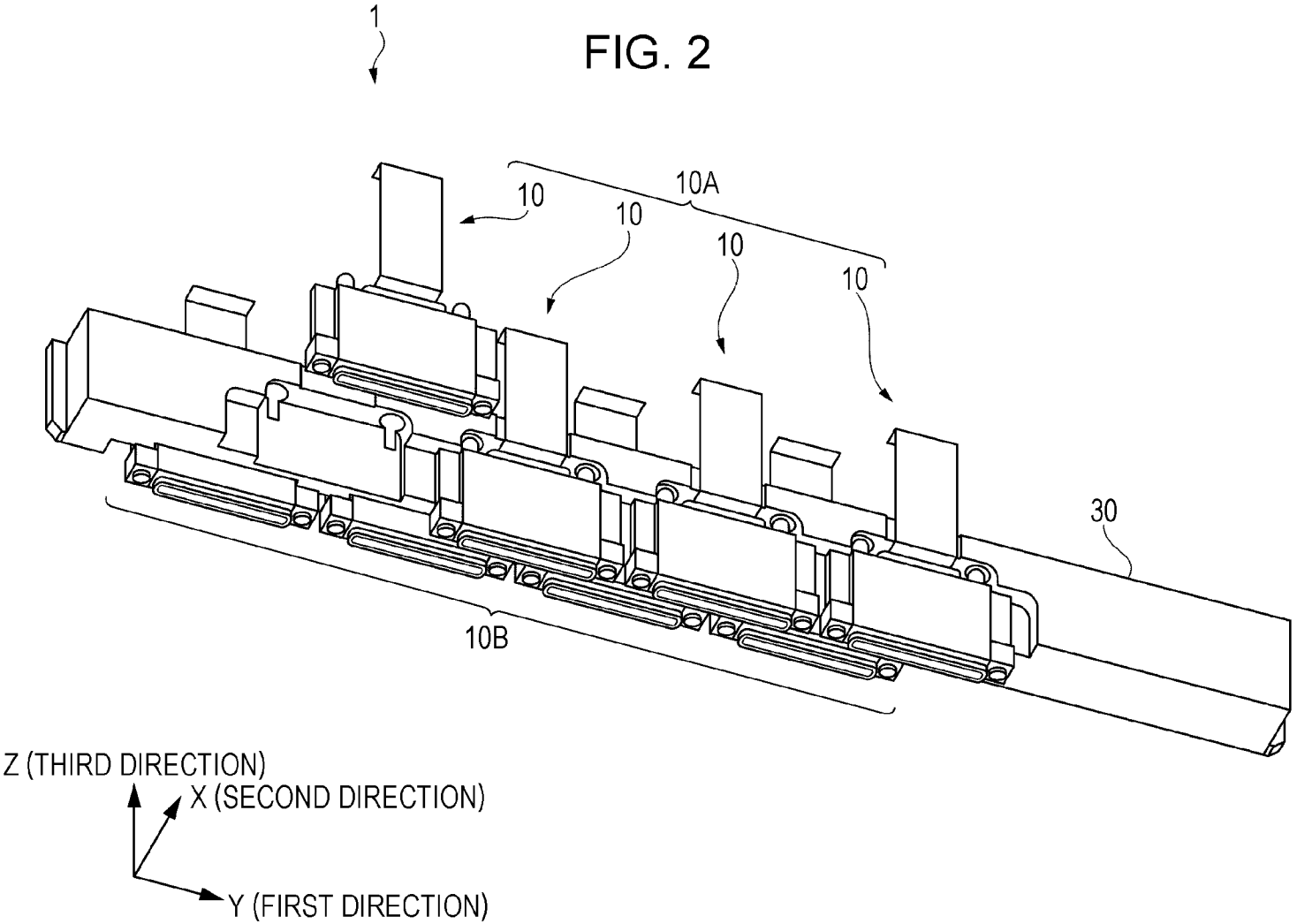
FIG. 2 is a schematic perspective view illustrating the bottom face side of the head unit according to the embodiment.

FIG. 1 is a schematic perspective view illustrating the top face side of a head unit according to a first embodiment of the invention, and FIG. 2 is a schematic perspective view illustrating the bottom face side of the head unit according to the embodiment. The top face side of the head unit is a face on the opposite side to a liquid ejecting surface of a head to be explained later, and the bottom face side of the head unit is a face on the liquid ejecting surface side.

A head unit 1 includes a plurality of heads 10 and a holding member 30 that holds the heads 10.

The heads 10 form two head rows configured of head rows A and B in each of which four heads are aligned in a Y direction (first direction). The head rows A and B are arranged opposite to each other sandwiching the holding member 30 therebetween, and fixed to the holding member 30 in a state in which the relative positions between the heads 10 are specified.

Figure 3:
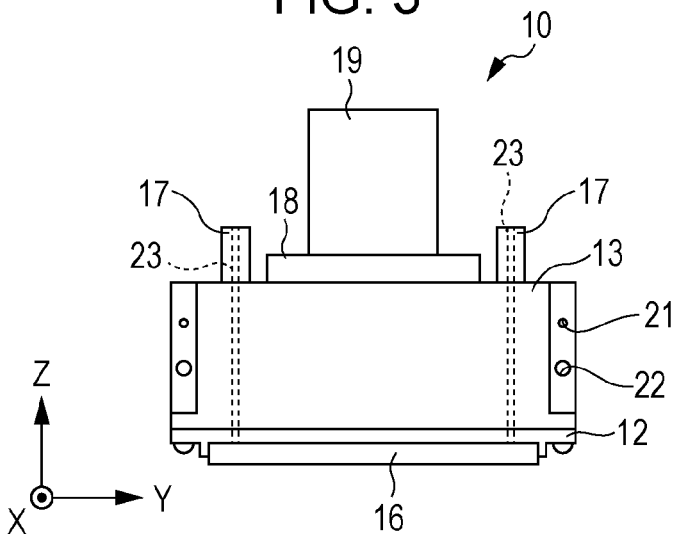
FIG. 3 is a front view illustrating the head according to the embodiment.
Figure 4:
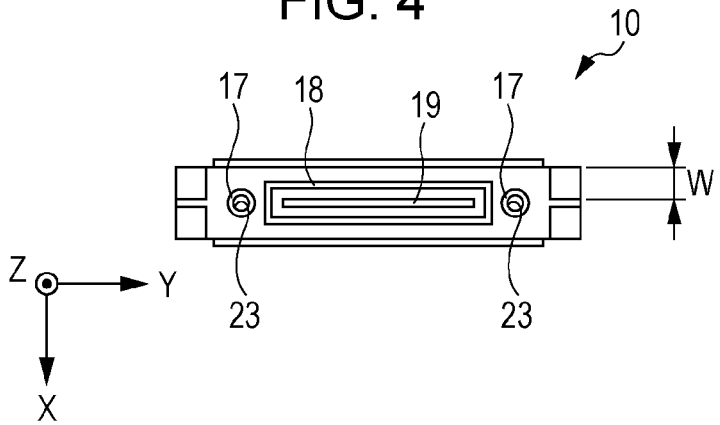
FIG. 4 is a top view illustrating the head according to the embodiment.
Figure 5:
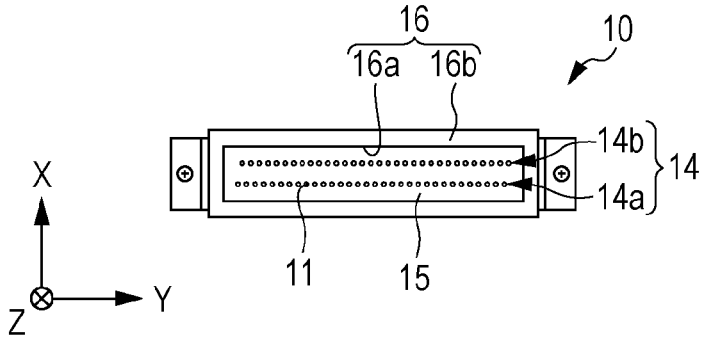
FIG. 5 is a bottom view illustrating the head according to the embodiment.

The head 10 will be described in detail with reference to FIGS. 3 through 5. FIG. 3 is a front view of the head 10, FIG. 4 is a top view of the head 10, and FIG. 5 is a bottom view of the head 10.

The head 10 includes a main head body 12 provided with nozzle openings 11, and a channel member 13 fixed to a surface on the opposite side of the main head body 12 to the nozzle openings 11.

The main head body 12 includes a nozzle row 14. A surface provided with the nozzle row 14 is referred to as a nozzle surface 15 (liquid ejecting surface).

The nozzle row 14 is a row in which a plurality of nozzle openings 11 are aligned in the Y direction (first direction). In this embodiment, two nozzle rows 14*a* and 14*b* are provided in which the nozzle openings 11 are aligned extending linearly in the Y direction. The nozzle openings 11 of the nozzle row 14*a* as one row and the nozzle openings 11 of the nozzle row 14*b* as the other row are formed while being shifted from each other by a half pitch. The nozzle rows 14*a* and 14*b* are configured to eject the same kind of liquid, and the two nozzle rows 14*a* and 14*b* form substantially the single nozzle row 14. In the invention, the nozzle row 14 formed in a substantially single nozzle row is called a nozzle row. With this configuration, the resolution can be doubled. The nozzle row may be formed in a mode in which three or more rows configure substantially a single nozzle row. Needless to say, it may be that the head 10 is provided with a nozzle row formed by just one row. Moreover, it may be that the head 10 includes two or more nozzle rows and these nozzle rows eject different kinds of liquid from each other; in this case, a plurality of nozzle rows will be provided.

A cover head 16 to protect the nozzle surface 15 is provided on the main head body 12. The cover head 16 is configured of an opening portion 16*a* from which the nozzle row 14 is exposed and a frame 16*b* that defines the opening portion 16*a*. The frame 16*b* covers the circumferential portion of the nozzle surface 15 so as to protect the nozzle surface 15.

Inside the main head body 12, although not shown, there are provided a pressure generation chamber configuring a part of a channel that communicates with the nozzle openings 11 and a pressure generation unit that causes a change in pressure in the pressure generation chamber so as to discharge liquid through the nozzle openings.

The pressure generation unit is not limited to any specified one, and the following can be used, for example: that is, a unit that employs a piezoelectric element in which a piezoelectric material having an electromechanical conversion function is sandwiched between two electrodes; a unit such that a heating element is provided within the pressure generation chamber and droplets are discharged through the nozzle openings 11 by bubbles generated by the heat from the heating element; a unit such that static electricity is generated between a vibration plate and electrodes and droplets are discharged through the nozzle openings 11 by the deformation of the vibration plate due to electrostatic force; and so on. As a piezoelectric element, the following can be used: that is, a flexural vibration type piezoelectric element in which a lower-side electrode, a piezoelectric material, and an upper-side electrode are laminated in that order from the pressure generation chamber side so as to generate flexural vibration; a longitudinal vibration type piezoelectric element in which a piezoelectric material and an electrode formation material are alternately laminated so as to make the laminated materials expand and contract in the axis direction; and so on.

The channel member 13 is a member that is fixed to a surface on the opposite side to the nozzle openings 11 of the main head body 12, and that includes an ink channel 23 (second liquid channel) which supplies ink from external to the main head body 12 and discharges ink from the main head body 12 to external. In a surface of the channel member 13 on the opposite side to the surface that is fixed to the main head body 12, there is provided an insertion portion 17 in which the ink channel 23 inside the channel member 13 is open. At the upper surface side of the insertion portion 17, the ink channel 23 is open. The insertion portion 17 is connected with a connection channel 32 (first liquid channel), details of which will be explained later.

Further, a connector 18 to which an electric signal such as a print signal or the like is supplied from external is provided on the surface on the opposite side of the channel member 13 to the surface which is fixed to the main head body 12. A flexible connection wiring 19 such as an FPC or the like for transmitting the print signal is connected to the connector 18.

A fixing portion 20 sticking out in the Y direction is provided in the channel member 13. The fixing portion 20 is formed in a plate-like shape approximately parallel with a Y-Z plane, and is provided approximately at the center in the X direction of the channel member 13. In the fixing portion 20, a positioning hole 21 and a fixing screw insertion hole 22 are provided penetrating through in the thickness direction. The positioning hole 21 and the fixing screw insertion hole 22 are positioned in compliance with the positioning reference of the holding member 30, details of which will be explained later. The positioning hole 21 and the fixing screw insertion hole 22 are fixed to the holding member 30 being positioned in compliance with the positioning reference, whereby the relative positions between the heads 10 are specified.

Figure 6:
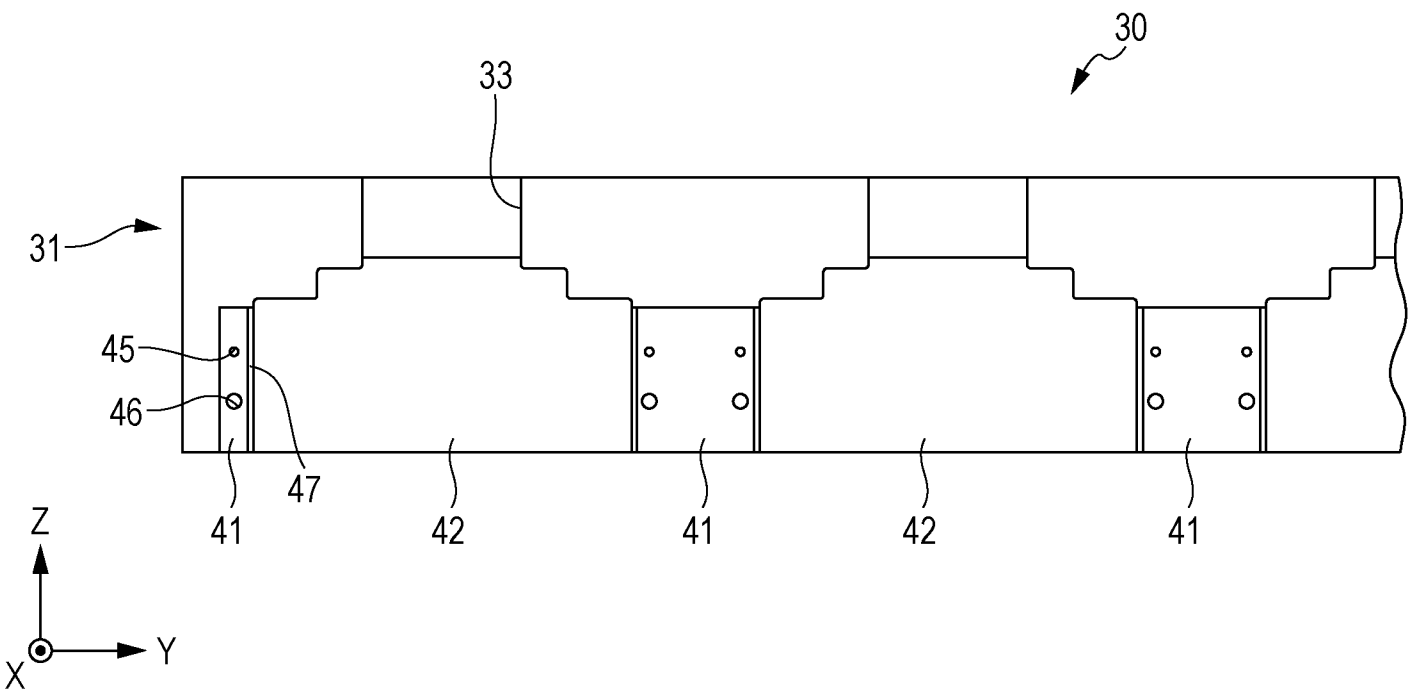
FIG. 6 is a front view illustrating a holding member according to the embodiment.
Figure 7:
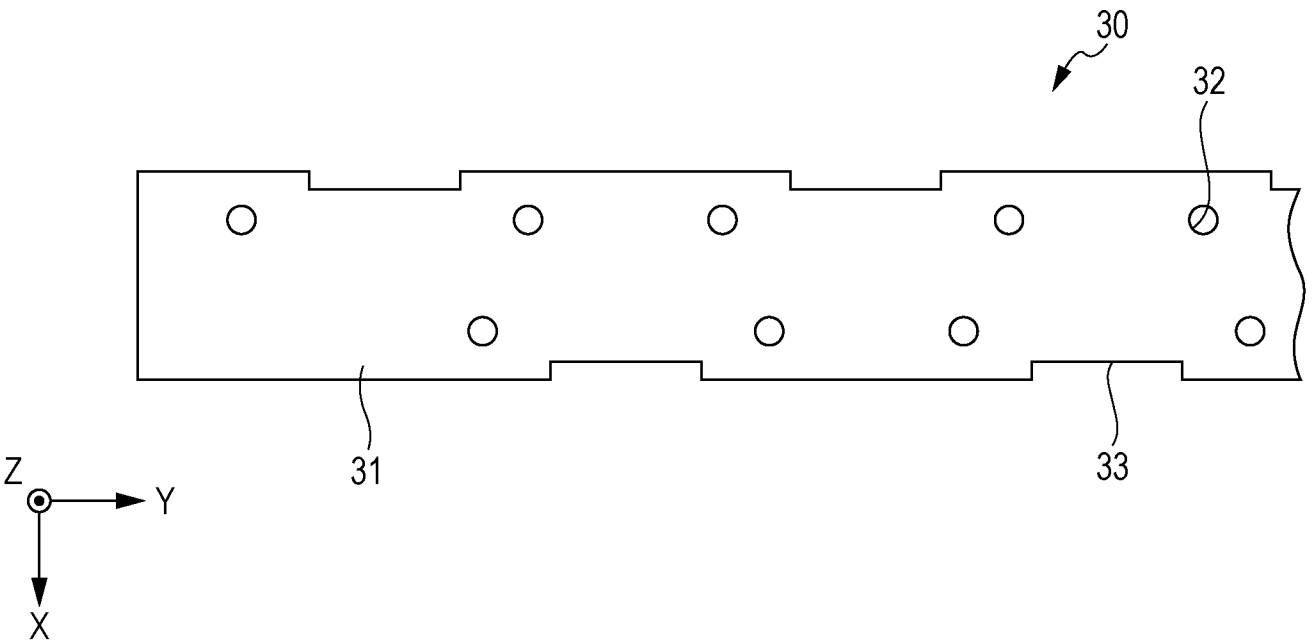
FIG. 7 is a top view illustrating the holding member according to the embodiment.
Figure 8:
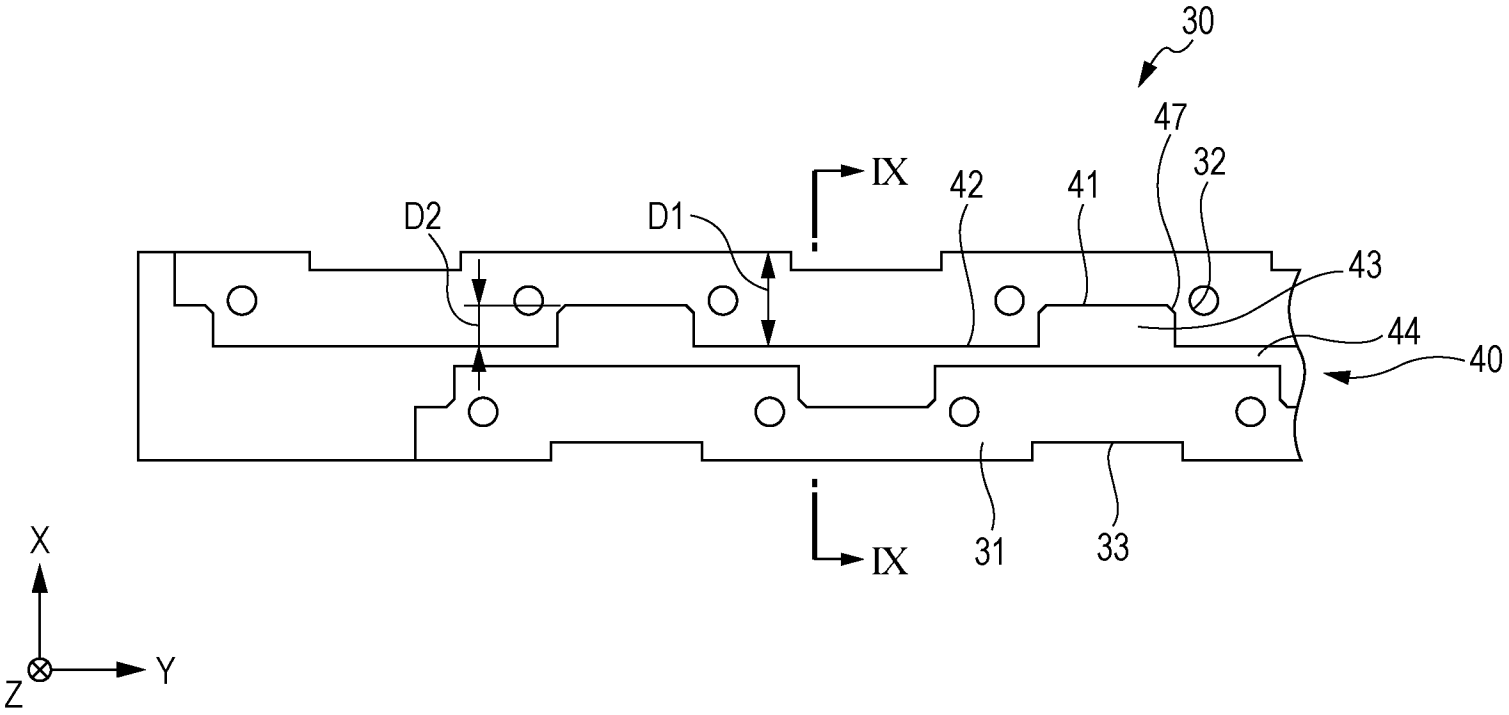
FIG. 8 is a bottom view illustrating the holding member according to the embodiment.
Figure 9:
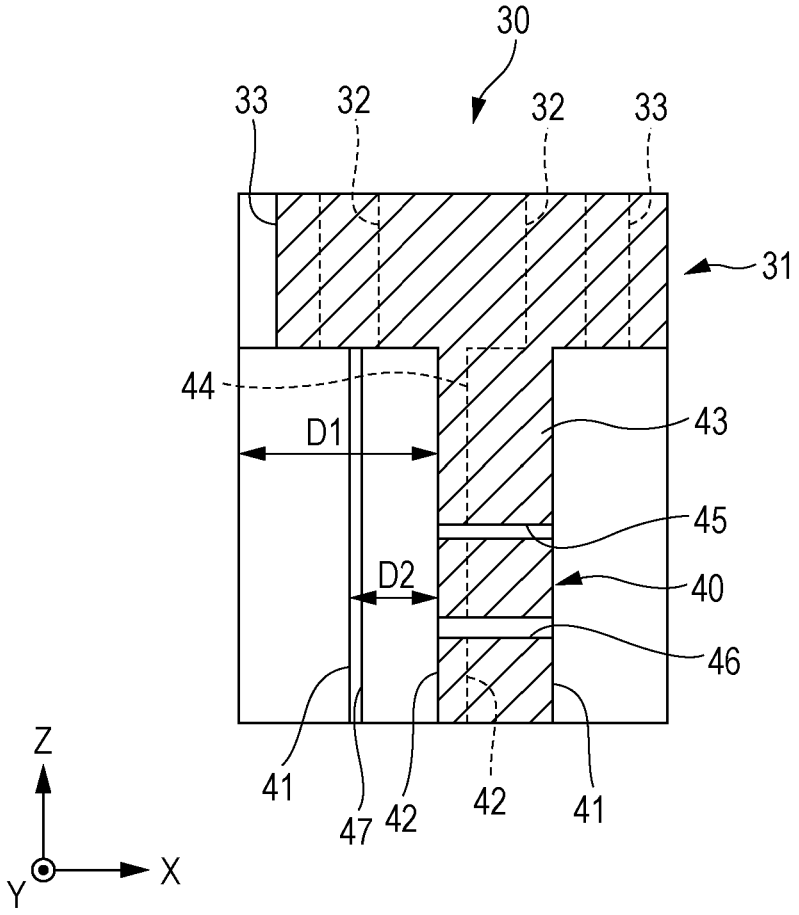
FIG. 9 is a cross-sectional view taken along a IX-IX line in FIG. 8.

Details of the holding member will be described with reference to FIGS. 6 through 9 hereinafter. FIG. 6 is a front view of the holding member, FIG. 7 is a top view of the holding member, FIG. 8 is a bottom view of the holding member, and FIG. 9 is a cross-sectional view taken along a IX-IX line in FIG. 8.

The holding member 30 is a member that is formed to be elongated in the Y direction and that holds a head row 10A and a head row 10B. More specifically, the holding member 30 includes a base portion 31 and a holder 40 to which the head 10 is attached. Further, as shown in FIG. 9, the cross-section of the holding member 30 is formed approximately in a T shape. In the approximate T shape, the crossbar portion corresponds to the base portion 31 and the vertical bar portion corresponds to the holder 40. However, the invention is not limited to the approximate T shape. For example, there may be provided a portion that sticks out upward from the crossbar portion of the approximate T shape like a cross-shape or a portion that sticks out downward therefrom.

The base portion 31 is a portion that is formed in a plate-like shape having a surface approximately parallel to the nozzle surface 15 (see FIG. 5), and that is located on the top face side of the heads 10. The connection channel 32 (first liquid channel) is provided in the base portion 31 penetrating through in the thickness direction. The connection channel 32 is connected with the ink channel 23 (see FIGS. 3 and 4) that is open in the insertion portion 17 of the head 10. An ink tube 25 which is an example of the tube member is inserted into the connection channel 32 from a liquid storage unit such as an ink cartridge or the like, and ink is supplied to the ink channel 23 via the tube, details of which will be explained later. In this embodiment, two connection channels 32 are provided for each of the heads 10 in the base portion 31.

A connection wiring recess 33 is provided on a side surface of the base portion 31 (surface parallel to the Y-Z plane). The connection wiring 19 connected with the head 10 (see FIGS. 3 and 4) is accommodated in the connection wiring recess 33.

The holder 40 is erected on the base 31 to hold the head 10. The holder 40 is also called a support wall because it is a wall-like member for supporting the head 10. In this embodiment, the holder 40 is formed in a plate-like shape longer in the Y direction and shorter in the X direction. On both sides of the holder 40, there are provided a head attachment surface 41 and an accommodation portion 42 which is a concave portion recessed from the head attachment surface 41. The fixing portion 20 of the head 10 is attached to the head attachment surface 41, while the accommodation portion 42 is a space in which the main head body 12 and the channel member 13 of the head 10 are accommodated. Here, because it can be considered that the base portion 31 sticks out laterally from the holder 40 to reinforce the holder 40, the base portion 31 is also referred to as a flange.

To be more specific, the holder 40 has a configuration in which a thick portion 43 having the head attachment surface 41 and a thin portion 44 formed thinner than the thick portion 43 are included, and the thin portion 44 is located between the adjacent thick portions 43 in the Y direction to form the accommodation portion 42.

Here, the depth in the X direction from a side surface of the base portion 31 to the bottom surface of the accommodation portion 42 (front face of the thin portion 44) is taken as D1, and the depth in the X direction from the head attachment surface 41 to the bottom surface of the accommodation portion 42 is taken as D2. The depth D1 is formed slightly deeper than the width in the X direction of the head 10. The depth D2 is formed slightly deeper than a width W from the fixing portion 20 to a side surface in the X direction of the head 10 (see FIG. 4).

Accordingly, the head 10 fixed to the head attachment surface 41 is accommodated in the accommodation portion 42 without making contact with the bottom surface of the accommodation portion 42 and also without sticking out from the side surface of the base portion 31.

A positioning reference hole 45 and a fixing screw hole 46 each penetrating through in the width direction (X direction) of the thick portion 43 are provided in the head attachment surface 41. The positioning reference hole 45 specifies the relative positions between the heads 10, details of which will be explained later. The fixing screw hole 46 is a screw hole in which a fixing screw inserted through the fixing screw insertion hole 22 of the head 10 (see FIG. 3) is screwed, details of which will be explained later. The head 10 is fixed to the head attachment surface 41 with the fixing screw.

The accommodation portion 42 located on one of both the sides of the holder 40 is so provided as to be opposed to the head attachment surface 41 (thick portion 43) which is located on the other side. Meanwhile, one head attachment surface 41 is provided between the two accommodation portions 42 adjacent to each other in the Y-direction. Each of the fixing portions 20 of the two heads 10 that are respectively accommodated in those accommodation portions 42 adjacent to each other, is fixed to the one head attachment surface 41.

In this embodiment, the four accommodation portions 42 corresponding to the head row 10A and the four accommodation portions 42 corresponding to the head row 10B are respectively provided on both the sides of the holder 40, and the head attachment surfaces 41 are provided at both end sides in the Y direction of each of the accommodation portions 42. By attaching each of the heads 10 to the holder 40 having the above-described head attachment surface 41 and accommodation portion 42, the head row 10A and the head row 10B are opposed to each other sandwiching the holders 40 therebetween so as to be arranged in a zigzag pattern along the Y direction, details of which will be explained later.

Further, a tapered surface 47 is formed at a boundary between the head attachment surface 41 and the accommodation portion 42. The tapered surface 47 functions as a lead-in structure for guiding the head 10 into the accommodation portion 42 (holder 40 side), details of which will be explained later.

Note that in the holding member 30, the base portion 31 and the holder 40 are integrally formed as one unit. This enhances the rigidity of the base portion 31 and the holder 40. Needless to say, the base portion 31 and the holder 40 may be formed as different members from each other, and the holding member 30 may be formed by bonding those different members. Further, although the material of the holding member 30 is not limited to any specific material, it is preferable to use a material having a sufficient rigidity such as SUS or the like.

Figure 10:
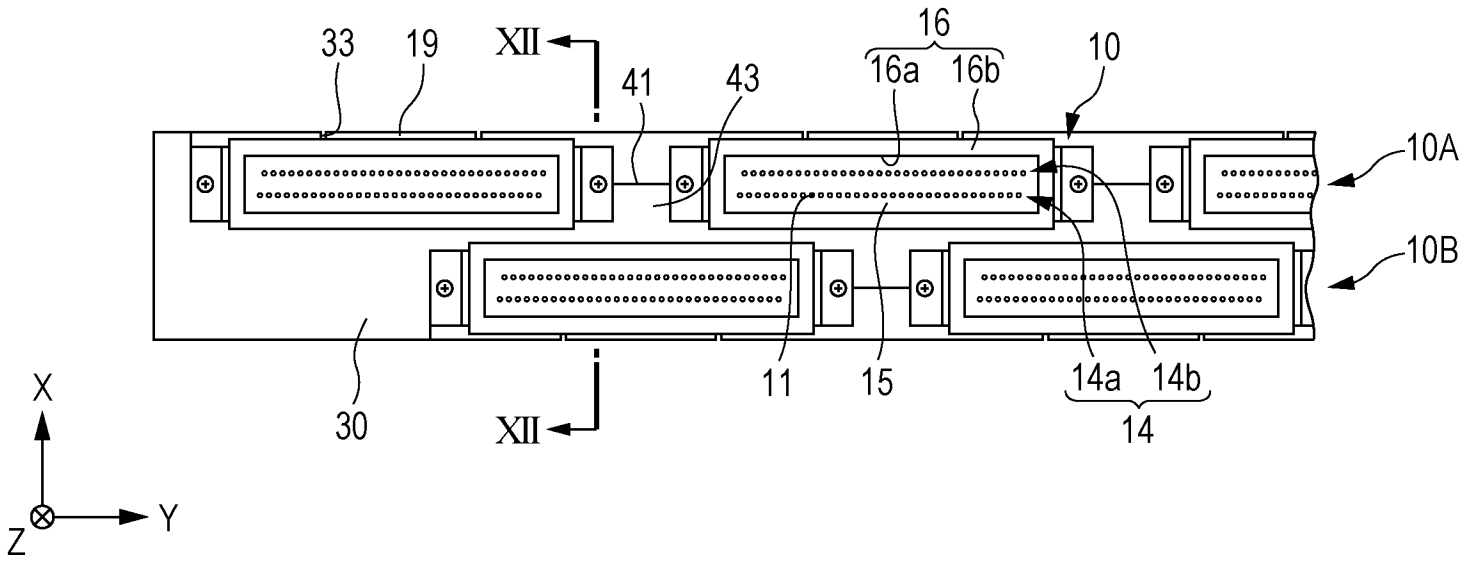
FIG. 10 is a bottom view illustrating the head unit according to the embodiment.
Figure 11:
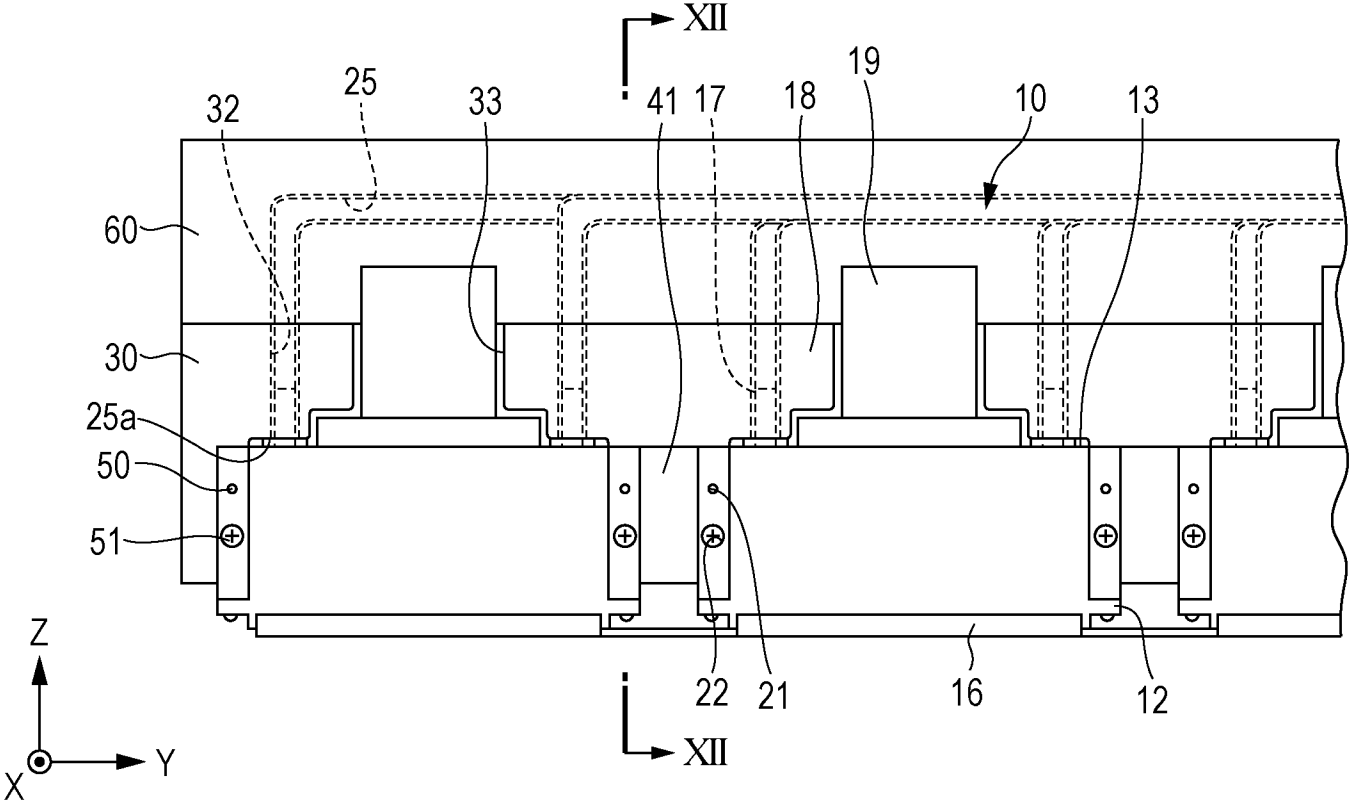
FIG. 11 is a front view illustrating the head unit according to the embodiment.
Figure 12:
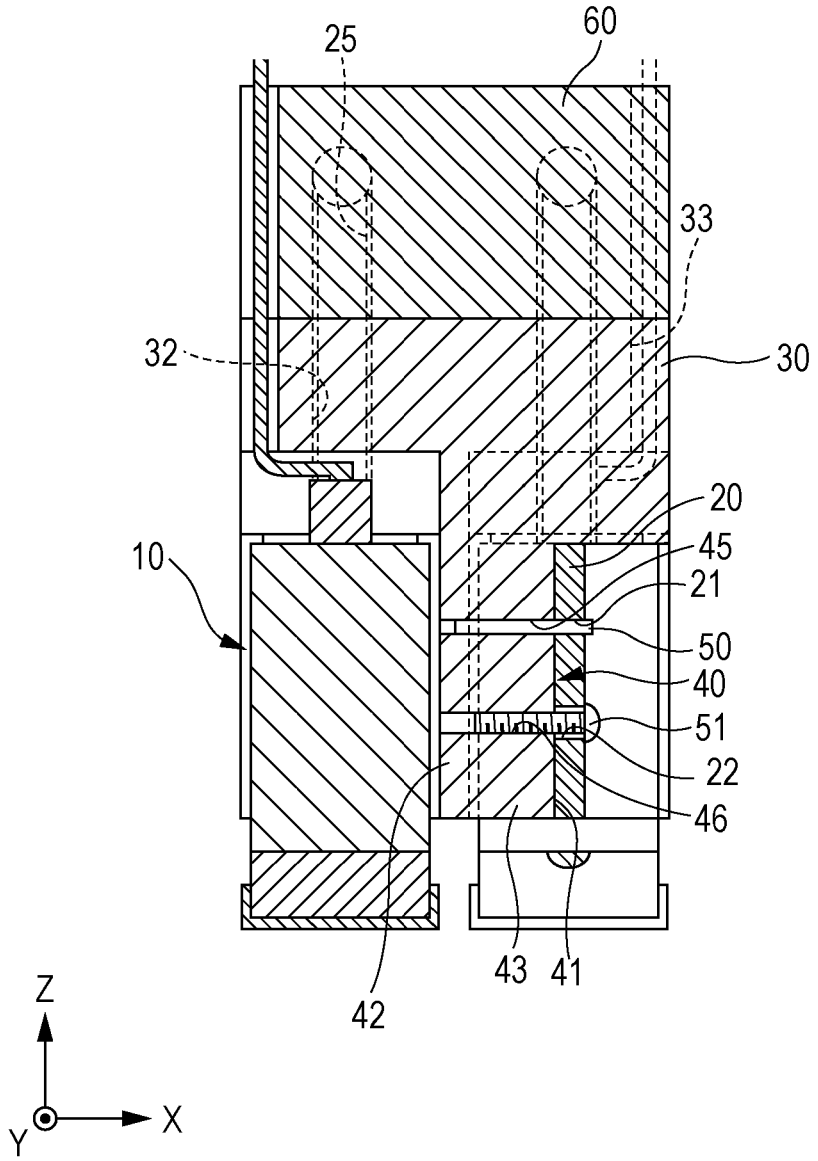
FIG. 12 is a cross-sectional view taken along a XII-XII line in FIG. 10.

Hereinafter, a structure in which the heads 10 are attached to the holding member 30 will be described in detail with reference to FIGS. 10 through 12. FIG. 10 is a bottom view of the head unit, FIG. 11 is a front view of the head unit, and FIG. 12 is a cross-sectional view taken along a XII-XII line in FIGS. 10 and 11.

The heads 10 that configure the head row 10A and the head row 10B are respectively fixed to both the sides of the holders 40 of the holding member 30. To be more specific, the heads 10 are fixed in the following manner.

The main head body 12 and the channel member 13 of each of the heads 10 are accommodated in the corresponding accommodation portion 42, and the fixing portion 20 thereof is in contact with head attachment surface 41. A positioning pin 50 is inserted through both the positioning hole 21 provided in the fixing portion 20 of the head 10 and the positioning reference hole 45 provided in the head attachment surface 41. The openings of the positioning hole 21 and the positioning reference hole 45 are both formed in a shape so as to make the opening to be in contact with the outer circumference of the positioning pin 50.

Further, a fixing screw 51 is inserted through the fixing screw insertion hole 22 provided in the fixing portion 20 and screwed into the fixing screw hole 46 provided in the head attachment surface 41. Note that the fixing screw 51 is not screwed into the fixing screw insertion hole 22, and the head of the fixing screw 51 fixes the fixing portion 20 to the head attachment surface 41.

The connection wiring 19 connected with the head 10 is accommodated in the connection wiring recess 33 provided on the base portion 31, and an end portion thereof is connected to a control device (not shown) that supplies a drive signal. Providing the connection wiring recess 33 on the base portion 31 makes it possible to accommodate the connection wiring 19 while preventing the connection wiring 19 from sticking out from a side surface of the base portion 31.

The head attachment surface 41 to which the head 10 is fixed in the manner described above and the positioning reference hole 45, function as a positioning reference that specifies the relative positions between the heads 10.

The head attachment surface 41 specifies the positions in the X direction of the heads 10. In other words, the position of the head 10 is determined by the fixing portion 20 of the head 10 making contact with the head attachment surface 41.

The positioning reference hole 45 specifies the positions in the Y and Z directions of the heads 10. In other words, the positioning hole 21 of the head 10 is positioned to the same position as that of the positioning reference hole 45 in the Y-Z plane and the positioning pin 50 is inserted through these holes, whereby the position of the head 10 in the Y and Z directions is determined. That is, by inserting the positioning pin 50 through the positioning reference hole 45 and the positioning hole 21, movement of the head 10 in the Y and Z directions is restricted.

In a state in which the position in the X, Y and Z directions is specified by the head attachment surface 41 and the positioning reference hole 45, as described above, the head 10 is fixed to the head attachment surface 41 with the fixing screw 51.

The head attachment surface 41 and the positioning reference hole 45, which function as the positioning reference in the manner described above, are formed in the holder 40 so as to specify the relative positions between the heads 10 being positioned by the head attachment surface 41 and positioning reference hole 45.

Here, the "relative positions between the heads 10" refers to an arrangement of the heads 10 such that the heads 10 are arranged in a zigzag pattern in the Y direction and the nozzle rows 14 of the heads 10 form a single continuous nozzle row unit.

The "heads 10 are arranged in a zigzag-pattern" refers to an arrangement as follows. That is, the nozzle openings 11 (one or more in number) located at the end side in the Y direction of the head 10 of the head row 10A (head row 10B) are arranged so that the position thereof overlaps with the position in the Y direction of the nozzle openings 11 of the head 10 of the head row 10B (head row 10A).

In the manner as describe above, the nozzle rows 14 are arranged to overlap partly with each other in the Y direction between the heads 10 so as to continue the nozzle rows 14, whereby the nozzle row unit forming the maximum print width as a whole is configured. In other words, the nozzle row unit is a unit in which the nozzle rows of all of the heads 10 in the head unit 1 are continued.

In this embodiment, the positioning reference is formed as follows in order to form the above nozzle row unit. That is, the head attachment surfaces 41 each serving as the positioning reference in the X direction are flush with each other with respect to every both sides of the holders 40. In other words, the nozzle rows 14*a* and 14*b* of the head row 10A and of the head row 10B being attached to the corresponding head attachment surfaces 41, are each linearly aligned on a line parallel to the Y direction.

The positioning reference hole 45 serving as the positioning reference in the Y and Z directions is formed so that the end portion of the nozzle openings 11 is overlapped in the Y direction in the manner described above, and the nozzle surfaces 15 are flush with each other in the Z direction.

By positioning the head 10 to the head attachment surface 41 and the positioning reference hole 45 serving as the positioning reference and fixing the head 10 with the fixing screw 51, there is provided the head unit 1 in which the nozzle surfaces 15 are flush with each other, the head rows 10A and 10B are opposed to each other sandwiching the holders 40 therebetween, and therefore the nozzle row unit is formed. Note that a channel member 60 is provided on the upper surface of the holding member 30 of the head unit 1. The channel member 60 is a member that holds therein the ink tube 25 in which ink supplied from an ink cartridge flows.

Figure 13:
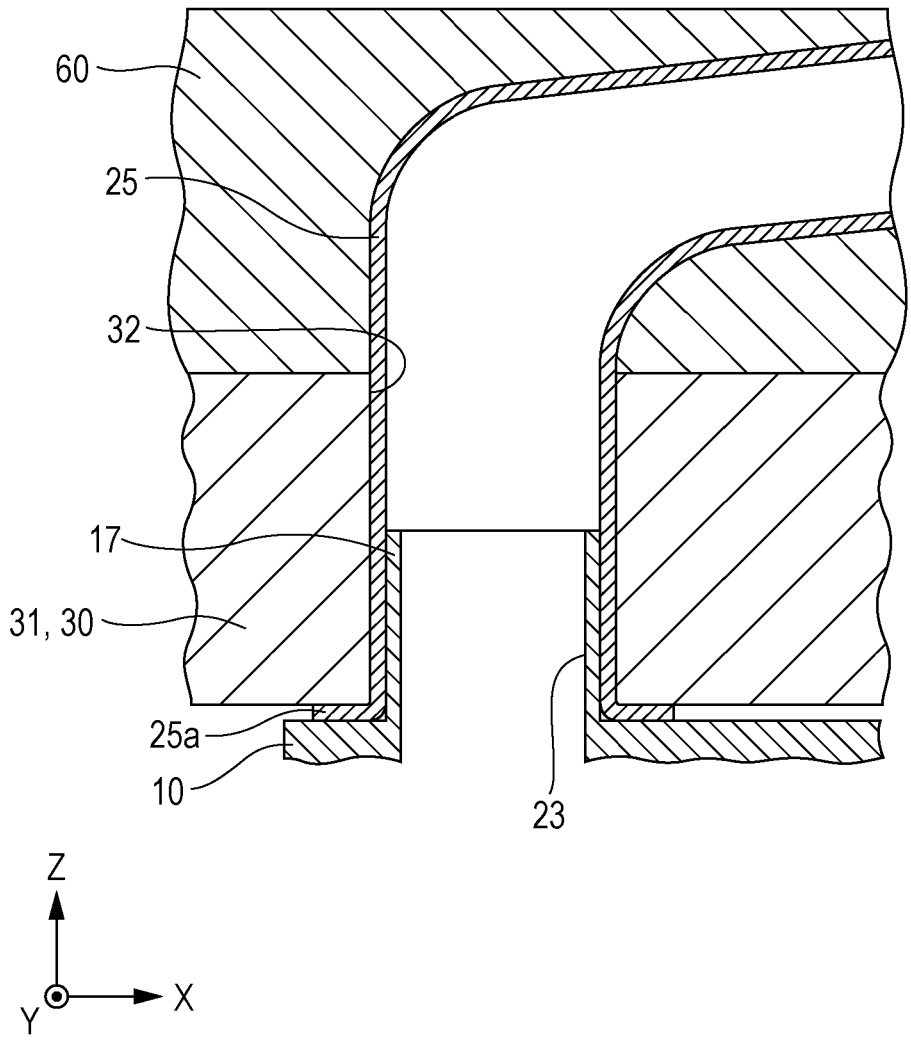
FIG. 13 is an enlarged cross-sectional view illustrating a principal portion of a connecting portion between the head and the holding member.

Hereinafter, a structure that supplies ink to the head 10 will described in detail with reference to FIG. 13. FIG. 13 is an enlarged cross-sectional view illustrating a principal portion of a connecting portion between the head 10 and the holding member 30.

The ink tube 25, which is an example of the tube member in which liquid flows, is inserted into the connection channel 32 of the holding member 30. The ink tube 25 is formed of a flexible material, and one end thereof is connected with the insertion portion 17 and the other end is connected with an ink cartridge (not shown). The outer diameter of the ink tube 25 is formed to be approximately the same as the inner diameter of the connection channel 32. In this embodiment, a plurality of ink tubes 25 corresponding to the ink channels 23 of the heads 10 are held in the channel member 60, and each leading portion of the ink tubes 25 is inserted into the connection channel 32. Note that in this embodiment, as described above, liquid flows inside of the ink tube 25 being positioned inside of the connection channel 32; even in such case, it will be described in this embodiment that "liquid flows inside the connection channel 32".

Meanwhile, in an area of the head 10 facing to the connection channel 32, there is provided the insertion portion 17 that sticks out toward the connection channel 32 side. The outer diameter of the insertion portion 17 is formed to be approximately the same as the inner diameter of the ink tube 25, and the ink channel 23 is open at the upper surface (surface on the connection channel 32 side) of the insertion portion 17. The insertion portion 17 is inserted into the inside of the ink tube 25 that is inserted into the connection channel 32, which makes the ink channel 23 communicate with the ink tube 25.

Further, a leading portion 25*a* of the ink tube 25 (end portion of the ink tube 25 on the insertion portion 17 side) sticks out toward the head 10 side from the connection channel 32 and is bent outward centered at the insertion portion 17. The leading portion 25*a* bent in this manner is sandwiched between the head 10 and the base portion 31.

In the above-described head unit 1, ink is supplied to the connection channel 32 from an ink cartridge (not shown) via the ink tube 25, and is further supplied to the main head body 12 via the ink channel 23 (see FIG. 3). Then, ink droplets are discharged through the nozzle openings 11 of each of the heads 10 based on the drive signal from the control device.

In the head unit 1 having been described thus far, each of the heads 10 is attached to the holder 40 of the holding member 30, and the insertion portion 17 in which the ink channel 23 is open faces the base portion 31; further, the ink channel 23 communicates with the ink tube 25 that is inserted into the connection channel 32. In other words, the ink channel 23 of the head 10 is open at the upper surface of the head 10 (surface on the opposite side to the nozzle surface 15) to be connected with the ink tube 25.

Figure 14:
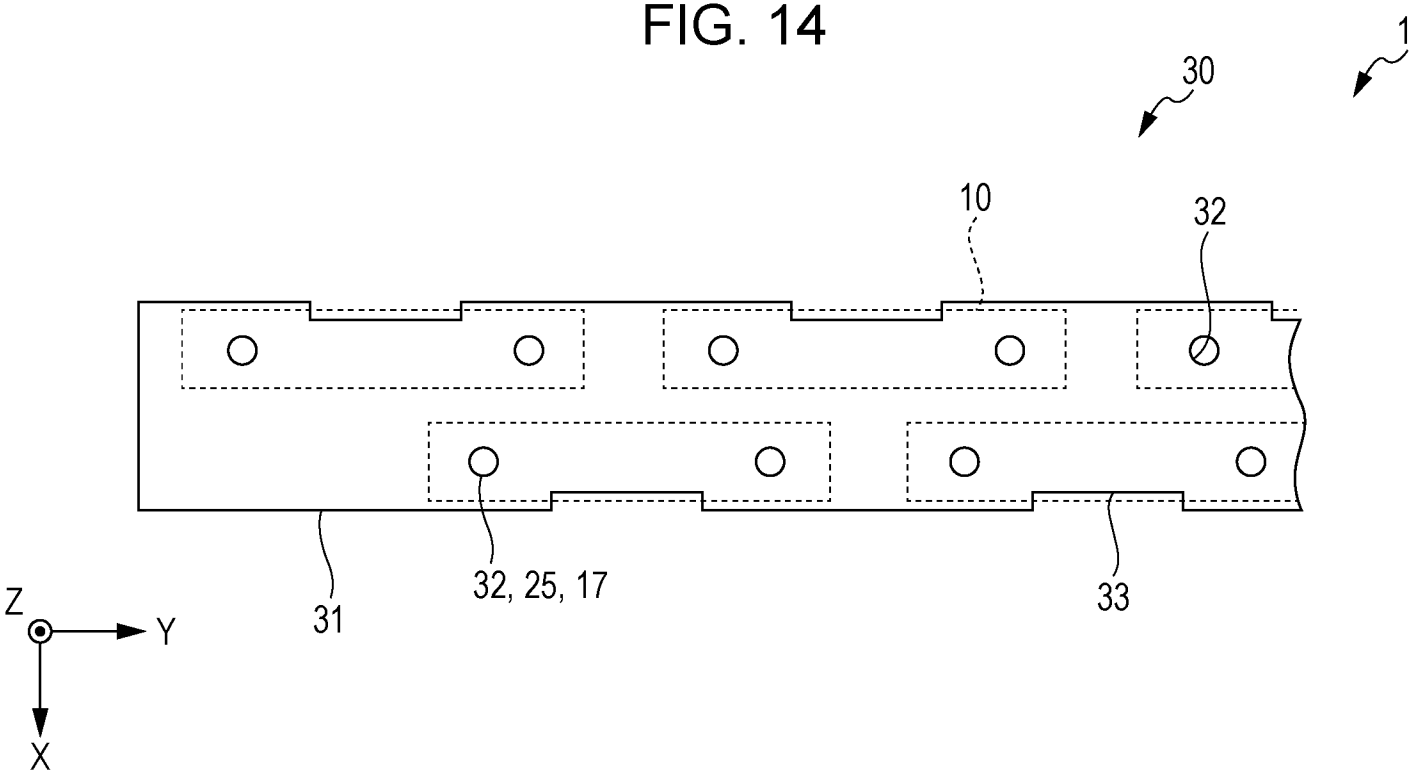
FIG. 14 is a top view illustrating the head unit.

As shown in a top view of the head unit in FIG. 14, by providing the insertion portion 17 in which the ink channel 23 is open at the upper surface side of the head 10, it is possible to arrange a connecting portion between the ink tube 25 and the head 10 (the insertion portion 17, the leading portion of the ink tube 25 to be inserted into the insertion portion 17, and the like) not at a position between the heads 10 in the X-Y plane, but at a position that overlaps with the head 10.

With this, because it is unnecessary to ensure an area between the heads 10 in which the connecting portion between the ink tube 25 and the head 10 is positioned, the interval between the heads 10 can be shortened as much as possible, which provides the miniaturized head unit 1.

Further, as shown in FIG. 13, the insertion portion 17 is inserted into the ink tube 25, and the ink tube 25 is inserted into the connection channel 32. By inserting the ink tube 25 into the connection channel 32 in this manner, the ink tube 25 is held in a state in which it linearly extends along the connection channel 32. This prevents the ink tube 25 from being excessively bent from the leading portion connected with the insertion portion 17.

As described above, since the ink tube 25 is prevented from being excessively bent, it is possible to prevent the pressure loss of ink within the ink tube 25 and to provide the head unit 1 having a preferable ink discharge characteristic.

Moreover, the leading portion 25*a* of the ink tube 25 is sandwiched between the base portion 31 and the head 10. This causes the ink tube 25 to adhere tightly to the upper surface of the head 10 (upper surface of the circumferential border of the insertion portion 17), thereby making it possible to prevent the leak of ink from the ink tube 25.

In the head unit 1 according to this embodiment, the fixing portion 20 of the head 10 is not attached to a surface parallel to the nozzle surface 15, but attached to the head attachment surface 41 intersecting with the nozzle surface 15.

Here, assume that the interval between the heads 10 is shortened so as to cause the nozzle openings 11 of the heads 10 configuring the head row 10A and head row 10B to overlap with each other in the Y direction. This requires the fixing portion 20 located between the heads 10 to be shorter in width in the Y direction. However, by widening the width in the Z direction of the fixing portion 20, the fixing portion 20 can have a sufficiently large size for stably fixing the head 10 to the head attachment surface 41.

As described above, the nozzle row unit is formed by making the interval between the heads 10 shorter, and the head unit 1 is provided in which the heads 10 are stably fixed to the holding member 30. In addition, because the heads 10 are stably fixed to the holding member 30 while the relative positions of the heads 10 are precisely arranged so as to form the nozzle row unit, the head unit 1 has a preferable ink discharge characteristic.

If it is attempted to fix the heads 10 to a member equivalent to the holding member on a surface parallel to the nozzle surface 15, a part for fixing the head 10 to the above-mentioned member need be formed more finely as the interval between the heads 10 is shorter. Because of this, the head 10 cannot be stably fixed to the above-mentioned member.

Moreover, in the head unit 1, it is possible to position the head 10 in the X, Y and Z directions with the head attachment surface 41 and positioning reference hole 45 provided in the holder 40. In other words, the head unit 1 can be obtained in which the relative positions between the heads 10 are specified only by causing the fixing portion 20 of the head 10 to make contact with the head attachment surface 41 and inserting the positioning pin 50 into the positioning reference hole 45 and the positioning hole 21.

In the past technique, in order to specify the relative positions between the heads 10, for example, the positioning is performed so that the nozzle openings 11 of the respective heads 10 are positioned to be a predetermined arrangement. Specifically, the nozzle openings 11 are pictured with a CCD camera or the like, the positions of the heads 10 are finely adjusted so that the nozzle openings 11 in the picture are arranged at a predetermined interval, and then the heads 10 are fixed to a member equivalent to the holding member.

However, with the head unit 1 according to this embodiment, unlike in the past technique, the relative positions between the heads 10 can be specified without carrying out fine adjustment on the positions of the heads 10. This is particularly advantageous in maintenance operation at the site where the head unit 1 is being used, because it is possible to noticeably reduce a workload, time, or the like needed for exchanging a specified head 10.

Figure 15:
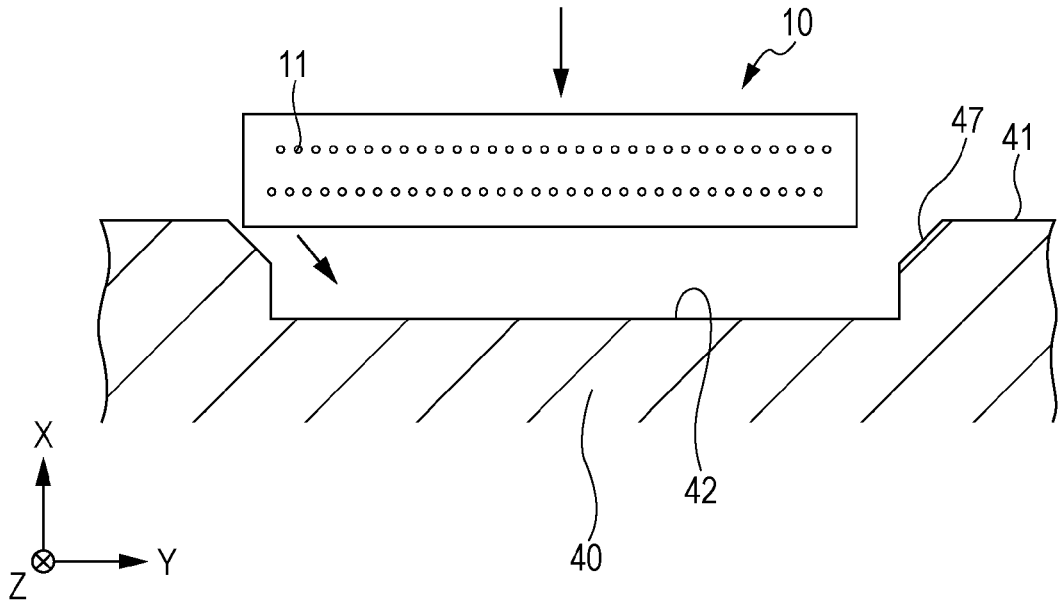
FIG. 15 is an enlarged bottom view illustrating a principal portion of the head unit for explaining a lead-in structure.

Providing the tapered surface 47 as a lead-in structure to the holder 40 makes it easy to attach the head 10 to the holder 40. This will be explained with reference to FIG. 15. FIG. 15 is an enlarged bottom view illustrating a principal portion of the head unit for explaining the lead-in structure.

As shown in FIG. 15, assume that the head 10 is to be accommodated in the accommodation portion 42 while being slightly deviated in the Y direction with respect to the accommodation portion 42. At this time, part of the head 10 makes contact with the tapered surface 47. Then, the head 10 is guided to the accommodation portion 42 side along the tapered surface 47.

Providing the lead-in structure to the accommodation portion 42 in the above manner makes it easy to accommodate the head 10 in the accommodation portion 42. With this, it is possible to reduce a workload, time, or the like needed for exchanging the heads 10 and to reduce maintenance costs in the exchanging of the heads.

Further, in the head unit 1 according to this embodiment, the accommodation portion 42 is provided in the holder 40, and the head 10 is accommodated in the accommodation portion 42 and fixed. This makes it possible to shorten the interval in the X direction between the heads 10 that are oppositely arranged sandwiching the holders 40 therebetween. In other words, the interval between the nozzle rows 14 of the heads 10 can be shortened. By shortening the interval in the X direction between the nozzle rows 14 in the above manner, it is possible to suppress influence of meandering transport of a medium such as paper onto which ink is discharged, whereby deterioration in the print quality can be prevented.

Second Embodiment

In the first embodiment, the ink channel 23 is open in the insertion portion 17 and is connected with the ink tube 25 being inserted into the connection channel 32; however, the invention is not limited thereto.

Figure 16:
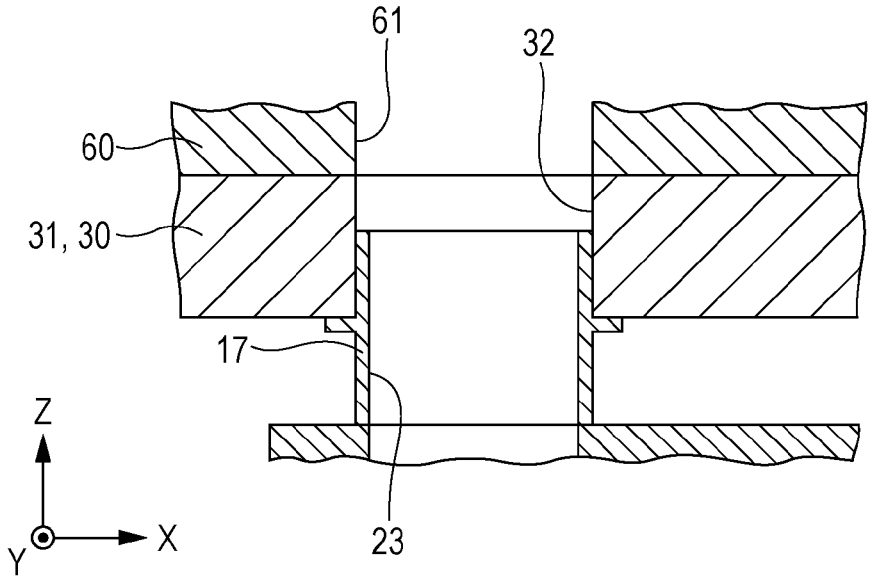
FIG. 16 is an enlarged cross-sectional view illustrating a principal portion of a connecting portion between the head and the holding member.

FIG. 16 is an enlarged cross-sectional view illustrating a principal portion of a connecting portion between the head 10 and the holding member 30 according to a second embodiment of the invention. Note that the same elements as those in the first embodiment will be given the same reference numerals and duplicate description thereof Will be omitted.

The insertion portion 17 according to this embodiment is directly connected with the connection channel 32. That is, unlike in the first embodiment, the insertion portion 17 is connected with the connection channel 32 without using the ink tube 25. The connection channel 32 communicates with a channel 61 of the channel member 60 that is provided to the holding member 30, for example. The channel 61 of the channel member 60 supplies ink to the connection channel 32, and this supplied ink is then supplied to the ink channel 23.

In the head unit 1 of the above configuration in which the ink tube 25 is not used, because the connection channel 32 extends linearly penetrating through in the thickness direction, it is possible to prevent the pressure loss due to an excessively bent ink channel. In addition, the head unit 1 in this configuration can be also miniaturized like in the first embodiment.

Third Embodiment

Figure 17:
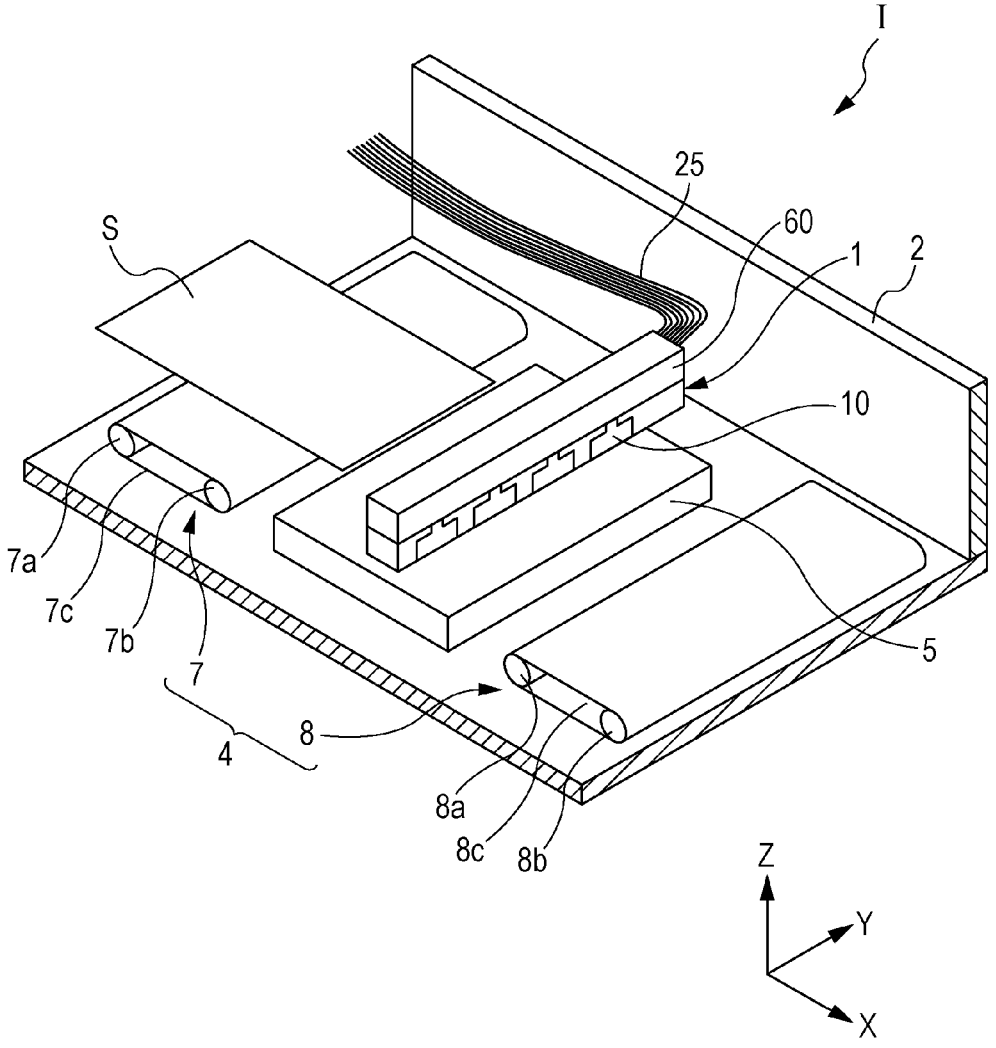
FIG. 17 is a schematic view illustrating a recording apparatus according to another embodiment of the invention.

An ink jet recording apparatus as an example of a liquid ejecting apparatus including the head unit 1 according to the first embodiment will be described. FIG. 17 is a schematic perspective view of an ink jet recording apparatus according to a third embodiment of the invention. Note that the same elements as those in the first embodiment are given the same reference numerals and duplicate description thereof will be omitted.

An ink jet recording apparatus I is what is known as a line type recoding apparatus in which the head unit 1 is fixedly installed and printing is performed by transporting an ejection-target medium such as a recording sheet. To be more specific, the ink jet recording apparatus I includes the head unit 1, a main apparatus body 2, and a transport unit 4 that transports an ejection-target medium S.

The head unit 1 is installed in the main apparatus body 2 so that the ejection-target medium S is transported in a transport direction (X direction) orthogonal to the alignment direction (Y direction) of the nozzle row 14 (see FIG. 5). As described in the first embodiment, in the head unit 1, the heads 10 are arranged in a zigzag pattern along the Y direction, and the nozzle row unit is included in the head unit 1. This makes it possible to perform printing across the entire area in the Y direction intersecting with the transport direction of the ejection-target medium S.

The channel member 60 is provided on the upper surface side of the head unit 1. The channel member 60 is a member that is supplied with ink via the ink tube 25 from an ink storage unit (not shown) in which ink is stored such as an ink tank, an ink cartridge, or the like, and that supplies the ink to each of the heads 10 via the connection channel 32 of the holding member 30. The ink tube 25 is held in the channel member 60 with its leading portion being inserted into the connection channel 32 of the holding member 30, as described in the first embodiment, and the insertion portion 17 of the head 10 (ink channel 23) is inserted into the ink tube 25.

A transport unit 4 includes a first transport unit 7 and a second transport unit 8 that are respectively provided on both sides in the X direction of the head unit 1.

The first transport unit 7 is configured of a drive roller 7*a*, a driven roller 7*b*, and a transport belt 7*c* wound upon the drive roller 7*a* and the driven roller 7*b*. The second transport unit 8 includes, like the first transport unit 7, a drive roller 8*a*, a driven roller 8*b*, and a transport belt 8*c*.

The drive roller 7*a* of the first transport unit 7 and the drive roller 8*a* of the second transport unit 8 are each connected with a driving unit (not shown) such as a driving motor, and the ejection-target medium S is transported on the upstream side and the downstream side of the head unit 1 by rotation of the transport belts 7*c* and 8*c* each driven by a driving force of the driving unit.

In this embodiment, the first transport unit 7 configured of the drive roller 7*a*, the driven roller 7*b* and the transport belt 7*c*, and the second transport unit 8 configured of the drive roller 8*a*, the driven roller 8*b* and the transport belt 8*c* are exemplified; however, a holding unit that causes the ejection-target medium S to be held on the transport belts 7*c* and 8*c* may be additionally provided. For example, the holding unit may have a charging unit that charges the outer periphery of the ejection-target medium S, and may cause the charged ejection-target medium S to stick to the upper side of the transport belts 7*c*, 8*c* by the effect of dielectric polarization. Further, a press-down roller may be provided as a holding unit on each of the transport belts 7*c* and 8*c*, and the ejection-target medium S may be pinched between the press-down rollers and the transport belts 7*c*, 8*c*.

According to the above-mentioned ink jet recording apparatus I, preferable printing can be performed on the ejection-target medium S because the heads 10 are stably fixed to the holding member 30.

In the example described above, although the head unit 1 is fixed to the main apparatus body 2 and the transport unit 4 is configured to transport the ejection-target medium S, the invention is not limited to such mode. Since it is sufficient that the transport unit 4 relatively moves the head unit 1 and the ejection-target medium S, the transport unit 4 may transport the head unit 1 while the ejection-target medium S being fixed. Moreover, the ink jet recording apparatus I may include not only the single head unit 1, but also a plurality of head units 1.

Other Embodiments

Thus far, the embodiments of the invention have been described. However, the basic configuration of the invention is not limited thereto. For example, the above-described embodiments may be combined with each other, or may be combined with the following modes.

Although, in the first embodiment, the leading portion of the ink tube 25 is bent to the outer side of the insertion portion 17 and sandwiched between the base portion 31 and the head 10, the invention is not limited thereto. For example, the ink tube 25 may be inserted into the connection channel 32 without the tube being bent, and in this state, the insertion portion 17 may be inserted into the ink tube 25. On the other hand, the ink tube 25 may be inserted into the connection channel 32 without being bent, and the ink tube 25 may be inserted into the insertion portion 17.

Further, although the ink channel 23 is open in the insertion portion 17 of the head 10, the invention is not limited thereto. For example, an opening into which the ink tube 25 can be fitted may be provided in a surface of the head 10 that is opposed to the base portion 31, and the ink channel 23 within the head 10 may communicate with the ink tube 25 when the ink tube 25 is fitted into the opening.

Furthermore, although the head unit 1 includes the two rows of the head row 10A and head row 10B that are arranged in a zigzag pattern, the invention is not limited thereto. For example, the heads 10 may be fixed to the holders 40 in a manner such that a head row is formed at only one side of the holders 40. Even in this case, it is possible to miniaturize the head unit 1 by shortening the interval between the heads in the Y direction of the above head row, and to prevent the ink tube 25 from being excessively bent.

Although the positioning reference hole 45 as a positioning reference specifies a position in the Y and Z directions of the head 10, the invention is not limited thereto. That is, for example, the positioning reference hole 45 is considered to be a hole that specifies a position in the Y direction. In this case, the positioning reference hole 45 has such a diameter in the Y direction that makes contact with the outer circumference of the positioning pin 50, and has such a diameter in the Z direction that is larger than the positioning pin 50. In other words, the positioning reference hole 45 is made to be an elongate hole, which is lengthened in the Z direction.

With this, in the case where the positioning pin 50 is inserted through the positioning reference hole 45 and the positioning hole 21, the head 10 is restricted to move in the Y direction but allowed to move in the Z direction to a small extent.

Then, the base portion 31 is provided with a positioning reference (base portion-side reference) in the Z direction. Although the form or the like of the base portion-side reference is not limited to any specified form or the like, a part in contact with the upper surface of the head 10 can be made to be the base portion-side reference, for example. The base portion-side reference is provided to the base portion 31 so as to specify the relative positions in the Z direction between the heads 10 that are fixed to the holder 40 being positioned in compliance with the base portion-side reference.

As described above, in the case where the positioning reference in the Z direction can be provided to the base portion 31, the position in the Z direction of the head 10 can be specified through positioning the head 10 in compliance with the positioning reference provided to the base portion 31.

The positioning references can be realized in various modes without being limited to the head attachment surface 41, the positioning reference hole 45, or the like. For example, a projection provided on a side surface of the holder 40 can be made to be a positioning reference in place of the positioning reference hole 45. By inserting the projection into the positioning hole 21, the position of the head 10 can be specified.

The invention can be widely applied to liquid ejecting heads in general. That is, the invention can be applied to, for example, recording heads such as various kinds of ink jet recording heads that are used in image recording apparatuses such as a printer or the like, coloring material ejecting heads used in the manufacture of color filters for liquid crystal displays and the like, electrode material ejecting heads used in the formation of electrodes for organic EL displays, field ejection displays (FEDs) and the like, bioorganic matter ejecting heads used in the manufacture of biochips, and so on. It is needless to say that liquid ejecting apparatuses equipped with these liquid ejecting heads are not limited to any specified apparatuses.

What is claimed is:

1. A liquid ejecting head unit comprising:

a liquid ejecting head configured to eject liquid through a nozzle formed in a nozzle surface; and a holding member to which the liquid ejecting head is removably attached, the holding member is formed with:

a holder portion that supports the liquid ejecting heads in a predetermined direction which is different from a direction of the nozzle surface of the liquid ejecting head, the holder portion having a plurality of openings each being open in the predetermined direction and arranged along a length of the holder, the holder portion having a stepped configuration along the length of the holder portion and a bottom surface of each of the openings having another stepped configuration; and a base portion that sticks out from the holder portion to a side which is parallel to the predetermined direction, wherein the base portion includes a first liquid channel which penetrates through in a thickness direction of the base portion and in which liquid is made to flow, the liquid ejecting head includes a second liquid channel that supplies liquid to the nozzle.

2. The liquid ejecting head unit according to claim 1, wherein the base portion is so provided as to stick out from a position on the holder portion at an opposite side to the nozzle surface of the liquid ejecting head.

3. The liquid ejecting head unit according to claim 1, wherein the holding member is made of a metal.

4. The liquid ejecting head unit according to claim 1, the liquid ejecting head is fixed to the holder portion with an opening of the second liquid channel facing to the base portion, and the second liquid channel is connected with the first liquid channel.

5. The liquid ejecting head unit according to claim 4, wherein a tube member for flowing liquid is inserted into the first liquid channel, and the tube member is connected with the liquid ejecting head so as to flow the liquid.

6. The liquid ejecting head unit according to claim 5, wherein the liquid ejecting head includes an insertion portion in which the second liquid channel is open and which sticks out toward the first liquid channel, and the second liquid channel communicates with the tube member either by inserting the insertion portion into the inside of the tube member which is inserted into the first liquid channel or by inserting the tube member into the inside of the insertion portion.

7. The liquid ejecting head unit according to claim 5, wherein a leading portion of the tube member is bent outward centered at the insertion portion and is sandwiched between the liquid ejecting head and the base portion.

8. A liquid ejecting apparatus comprising:

the liquid ejecting head unit according to claim 1.

9. The liquid ejecting head unit according to claim 1, further comprising a connection wiring that is connected with the liquid ejecting head and bypasses the base portion.

10. The liquid ejecting head unit according to claim 1, wherein the base portion includes a recess on both sides of the base portion in the predetermined direction.

11. The liquid ejecting head unit according to claim 1, wherein a portion of the base portion extends across each of the plurality of opening in the predetermined direction.

12. A liquid ejecting head unit comprising:

a liquid ejecting head configured to eject liquid through a nozzle formed in a nozzle surface; and a holding member to which the liquid ejecting head is removably attached, the holding member is formed with:

a holder portion that supports the liquid ejecting heads in a predetermined direction which is different from a direction of the nozzle surface of the liquid ejecting head, the holder portion having a plurality of openings each being open in the predetermined direction and arranged along a length of the holder, the holder portion having a stepped configuration along the length of the holder portion and a bottom surface of each of the openings having another stepped configuration; and a base portion that sticks out from the holder portion to a side which is parallel to the predetermined direction, wherein the base portion is configured to accommodate a tube member, the tube member fluidly communicating with the liquid ejecting head.

13. A liquid ejecting head unit comprising:

a liquid ejecting head configured to eject liquid through a nozzle formed in a nozzle surface; and a holding member to which the liquid ejecting head is removably attached, the holding member is formed with:

a holder portion that supports the liquid ejecting heads in a predetermined direction which is different from a direction of the nozzle surface of the liquid ejecting head, the holder portion having a plurality of openings each being open in the predetermined direction and arranged along a length of the holder, the holder portion having a stepped configuration along the length of the holder portion and a bottom surface of each of the openings having another stepped configuration; and a base portion that sticks out from the holder portion to a side which is parallel to the predetermined direction, wherein the base portion includes a first liquid channel that fluidly communicates with a second liquid channel of the liquid ejecting head.

14. The liquid ejecting head unit according to claim 13, wherein the first liquid channel is configured to accommodate a tube member, the tube member fluidly communicating with the second liquid channel of the liquid ejecting head.

* * * * *